US005766096A

United States Patent [19]

Maruko et al.

[11] Patent Number: 5,766,096

[45] Date of Patent: Jun. 16, 1998

[54] THREAD-WOUND GOLF BALLS

[75] Inventors: Takashi Maruko; Junji Hayashi, both of Saitama, Japan

[73] Assignee: Bridgestone Sports Co., Ltd., Tokyo, Japan

[21] Appl. No.: 659,834

[22] Filed: Jun. 7, 1996

[30] Foreign Application Priority Data

Jun. 7, 1995 [JP] Japan ..... 7-164775

[51] Int. Cl.[6] ..... A63B 37/06; A63B 37/12

[52] U.S. Cl. ..... 473/365; 473/370; 473/373; 473/378; 473/DIG. 22

[58] Field of Search ..... 473/361, 363, 473/364, 365, 370, 373, 378, DIG. 22

[56] References Cited

U.S. PATENT DOCUMENTS 5,445,387 8/1995 Maruko et al. ..... 473/365 X 5,586,950 12/1996 Endo ..... 473/356

FOREIGN PATENT DOCUMENTS 2291811 7/1996 United Kingdom .

2291812 7/1996 United Kingdom .

*Primary Examiner*—George J. Marlo

*Attorney, Agent, or Firm*—Sughrue, Mion, Zinn, Macpeak & Seas, PLLC

[57] ABSTRACT

A thread-wound golf ball prepared by winding thread rubber around a center, and having a two layer cover. The inner cover is made of an ionomer resin mixture or blend of ionomers having an acid content of not greater than 15 percent by weight, and a melt flow rate measured at 190° C. of from 2 to 9. The outer cover is made of a resin having a hardness of 43 to 53 on the Shore D scale.

9 Claims, 4 Drawing Sheets

THREAD-WOUND GOLF BALLS

BACKGROUND OF THE INVENTION

1. Field Of The Invention

The present invention relates to a thread-wound golf ball prepared by winding thread rubber around a center to form a thread rubber ball, and then enclosing the thread rubber ball with a two-layer structured cover.

2. Related Art

Heretofore, as a thread-wound golf ball cover, there has been generally used a single-layer structured cover made of balata or an ionomer resin. A golf ball with a single-layer structured cover made of balata is advantageous in spin properties (easy to impart spin) and soft feel on impact, which are preferred by a skilled golf player. But it is disadvantageous in its poor cut resistance and poor durability. On the other hand, a golf ball with a single-layer structured cover made of an ionomer resin is advantageous in good cut resistance and good durability, but is disadvantageous in its poor spin properties and solid feel on impact. Thus, this ball may not be preferred by a skilled golf player.

In order to provide good spin properties and satisfactory feel on impact, which are preferred by a skilled golf player, and good durability at the same time, use of a two-layer structured cover having an inner cover and an outer cover has been proposed (Kokai HO6-343718). The golf ball set forth in claim 1 of the Kokai publication comprises an inner cover made of a high-acid-content ionomer resin having an acid content of at least 16 percent by weight, and an outer cover made of a relatively soft polymer material. These golf balls were developed to give long travel distance, good durability, good spin properties and satisfactory feel on impact by appropriate combination of an inner cover and an outer cover.

The ionomer resins having an acid content of at least 16 percent by weight, which are used in the inner cover of the golf ball disclosed in Kokai HO6-343718, are advantageous in that they contributes to increase in travel distance, but are disadvantageous in their rigidity and fragility. Because of this, in the golf balls disclosed in the Kokai publication, the inner cover is fractured during the repeated use, resulting in fracture of the two layer cover. Thus, these golf balls do not have satisfactory durability.

It would be desired if there were provided a thread-wound golf ball with a two-layer cover structure, which has satisfactory durability, with keeping sufficient travel distance, and good spin properties and good feel on impact preferred by a skilled golf player.

SUMMARY OF THE INVENTION

According to the present invention, there is provided a thread-wound golf ball comprising a thread rubber ball prepared by winding thread rubber around a center, and a two-layer cover enclosing the thread rubber ball therewith and comprising an inner cover made of an ionomer resin having an acid content of not greater than 15 percent by weight, and an outer cover made of a resin having a hardness of 43 to 53 on the Shore D scale.

In the present invention, the ionomer resins used to form the inner cover may be those resins prepared by cross-linking a copolymer of an olefin having from 2 to 8 carbon atoms and an unsaturated monocarboxylic acid having from 3 to 8 carbon atoms with a metal ion. The ionomer resins may preferably have an acid content of from 8 to 15 percent by weight, and a melt flow rate measured at 190° C. of from 2 to 9. The resins used to form the outer cover may be selected from ionomer resins, balata, polyurethane based thermoplastic elastomers, polyester based thermoplastic elastomers and polyamide based thermoplastic elastomers. The resins used to form the outer cover may preferably have a hardness of from 45 to 50 on the Shore D scale. The inner cover may preferably have a thickness of from 0.5 to 1.5 mm. The total thickness of the inner cover and the outer cover may preferably be in the range of from 1.0 to 3.0 mm. The center may preferably have an intrinsic frequency of from 2,000 to 4,000 Hz, an outer diameter of from 30 to 35 mm, and a weight of from 19.5 to 29.0 g.

The thread-wound golf balls of the present invention can give good spin properties and reasonably soft feel on impact preferred by a skilled golf player, sufficient durability and sufficient travel distance.

BRIEF DESCRIPTION OF THE DRAWINGS

The objects, features, and advantages of the invention will be better understood from the following description taken in conjunction with the accompanying drawings, in which.

DESCRIPTION OF THE PREFERRED EMBODIMENTS

Figure 1:
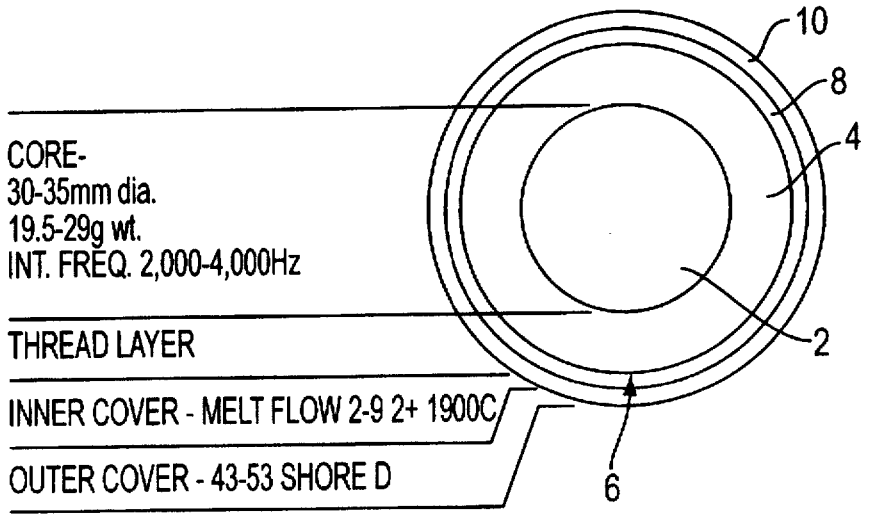
FIG. 1 shows a cross-sectional view of a thread-wound golf ball according to one embodiment of the present invention.

The present invention will be described in detail below.

In the present invention, suitable ionomer resins used to form an inner cover may be those prepared by cross-linking a copolymer of an olefin having from 2 to 8 carbon atoms and an unsaturated monocarboxylic acid having from 3 to 8 carbon atoms with a metal ion such as $Na^+$, $Zn^{2+}$, $Ca^{2+}$ or $Mg^{2+}$. In addition, these ionomers may be terpolymers comprising another co-polymerizable component. Of these, preferred are those prepared by cross-linking a copolymer of ethylene and acrylic acid or methacrylic acid with $Na^+$ or $Zn^{2+}$.

As the ionomer resin used to form the inner cover, a blend of two ionomers can be used, in addition to a single ionomer resin. If desired, several kinds of optional ingredients may be blended to the ionomer resin used to form the inner cover.

In the present invention, the ionomer resins used to form the inner cover have an acid content (content of unsaturated monocarboxylic acid) of not greater than 15 percent by weight. When the acid content exceeds 15 percent by weight, good durability of the resulting golf ball cannot be obtained since the inner cover will become rigid and fragile resulting in higher fracture rate on impact. The acid content may preferably range from 8 to 15 percent by weight, more preferably from 11 to 15 percent by weight. When the acid content is within this range, good initial velocity and improved durability can be firmly obtained.

In the present invention, the ionomer resins used to form the inner cover may preferably have a melt flow rate (MFR) measured at 190° C. of from 2 to 9. When the MFR is less than 2, the sealability between the thread rubber layer and the inner cover may become low since the inner cover material cannot easily intrude into recesses appearing on the surface of the thread rubber layer. On the other hand, when the MFR is greater than 9, molding may become difficult due to high flowability of the inner cover material. More preferred values of the MFR are 2.5 to 7.5.

In the present invention, suitable resins used to form an outer cover are not particularly limited to, but include any resins such as ionomer resins, balata, polyurethane based thermoplastic elastomers, polyester based thermoplastic elastomers and polyamide based thermoplastic elastomers. Particularly preferred are ionomer resins. Using the ionomer resins, durability and restitution of the outer cover can be improved.

As the resins used to form the outer cover, a blend of two or more resins can be used, in addition to a single resin. If desired, several kinds of optional ingredients may be blended to the resin used to form the outer cover.

In the present invention, the outer cover is made of a resin having a hardness of from 43 to 53 on the Shore D scale. As used herein, the hardness of the resin means hardness obtained after the resin is cross-linked or vulcanized. Use of a resin having a hardness of less than 43 on the Shore D scale will give poor initial velocity due to insufficient hardness of the outer cover, resulting in short travel distance. Use of a resin having a hardness of greater than 53 on the Shore D scale may not give good spin properties and reasonably soft feel on impact preferred by a skilled golf player due to rigidity of the outer cover. A more preferred range of the Shore D scale hardness may be from 45 to 50. Within this range, good initial velocity, good spin properties and good feel on impact can be firmly obtained.

In the present invention, the inner cover may preferably have a thickness of from 0.5 to 1.5 mm, more preferably from 0.7 to 1.2 mm. When the thickness is less than 0.5 mm, it sometimes may become difficult to obtain good initial velocity and good durability. When the thickness is more than 1.5 mm, feel on impact may become solid, resulting in unpleasant feel on impact. The outer cover may preferably have a thickness of from 0.5 to 1.5 mm, more preferably from 0.7 to 1.2 mm. When the thickness is less than 0.5 mm, sufficient spin properties may not be obtained for approach shot. When the thickness is more than 1.5 mm, the travel distance may be decreased due to high spin (great amount of spin) and low launch angle.

Further, the total thickness of the inner cover and the outer cover may preferably be in the range of from 1.0 to 3.0 mm, more preferably from 1.5 to 2.5 mm. When the total thickness is less than 1.0 mm, it may become difficult to obtain good durability. When the total thickness is more than 3.0 mm, the travel distance may be decreased due to poor initial velocity, and the feel on impact may become unpleasant.

The thread-wound golf balls of the present invention may be those prepared by winding thread rubber around a center to form a thread rubber ball, and enclosing the thread rubber ball with a two-layer cover comprising the above-mentioned inner cover and outer cover. In this case, the thread rubber ball may be one using a solid center or one using a liquid center. In addition, materials of the solid center or the liquid center; and outer diameter and weight of the center, the thread rubber ball and the resulting golf ball may be appropriately determined.

Methods for producing the thread-wound golf balls of the present invention are not particularly limited to, but include any methods such as a method comprising coating the inner cover on the thread rubber ball by compression or injection molding, and then coating the outer cover on the inner cover by compression or injection molding; and a method comprising firstly forming the two-layer cover, and then coating the two-layer cover on the thread rubber ball by compression molding.

The thread-wound golf balls of the present invention may preferably comprise a solid center having an intrinsic frequency of from 2,000 to 4,000 Hz, an outer diameter of from 30 to 35 mm, and a weight of from 19.5 to 29.0 g.

The golf balls comprising a solid center having an intrinsic frequency of from 2,000 to 4,000 Hz may give good "click" sound having a frequency of about 3,200 Hz on impact, which click sound is preferred by a skilled golf player. Also, reasonably soft and firm feel on impact can be obtained because of appropriate hardness of the solid center. When a large diameter solid center having an outer diameter of from 30 to 35 mm and a weight of from 19.5 to 29.0 g is used, the flight properties of the thread-wound golf balls may become closer to those of a two-piece ball, such as low spin (small amount of spin) and high launch angle, resulting in great travel distance, particularly when hit with a driver.

Thus, the thread-wound golf balls with the above-mentioned solid center according to the present invention, can give, by synergetic effects of the above-mentioned two-layer cover and the solid center, sufficient travel distance, good spin properties, good feel on impact and good impact sound preferred by a skilled golf player, and satisfactory durability.

As used herein, the "intrinsic frequency" means a peak frequency in power spectrum of restitution sound, which is obtained on impact between a solid center and a steel disk sufficiently larger than the solid center, when the solid center is dropped from a height of 120 cm onto the disc.

Further, as described later, the intrinsic frequency is in direct proportion to the hardness of the solid center. When the intrinsic frequency is less than 2,000 Hz, the feel on impact may become too soft. When the intrinsic frequency exceeds 4,000 Hz, the feel on impact may become too solid.

The solid center may preferably have an intrinsic frequency of from 2,200 to 3,600 Hz, more preferably from 2,500 to 3,400 Hz. Within such range, a golf ball giving most preferable impact sound and feel on impact, can be obtained.

The above-mentioned solid centers are not particularly limited to, but include those made of vulcanized rubber. Such solid centers may be prepared by adding, to butadiene rubber, additives such as vulcanizing agents (cross-linkers), vulcanization accelerators, accelerator aids, activating agents, fillers or modifiers; and then subjecting the obtained mixture to vulcanization and molding.

Further, the intrinsic frequency of the solid center may be adjusted by choosing the appropriate hardness and size of the solid center. In other words, since the intrinsic frequency is in direct proportion to the hardness of the solid center, the intrinsic frequency can be increased by making the solid center harder, and it can be decreased by making the solid center softer. Further, in a case where the solid centers are made of the same material, the intrinsic frequency is in inverse proportion to the outer diameter of the solid center. Thus, the intrinsic frequency can be decreased by making the diameter of the solid center larger, and it can be increased by making the diameter smaller.

In a case where the solid centers have the same intrinsic frequency, the greater the outer diameter of the solid center is, the harder the solid center becomes. Thus, travel distance can be increased by making the outer diameter of the solid center larger to make its travel properties closer to those of a two-piece ball, and making the solid center harder to have increased restitution.

The above-mentioned solid center may have an outer diameter of from 30 to 35 mm, and a weight of from 19.5 to 29.0 g. The resulting golf balls comprising a solid center with an outer diameter of less than 30 mm will not give low spin and high launch angle, resulting in short travel distance. Further, the resulting golf balls comprising a solid center with an outer diameter of more than 35 mm will have poor durability due to insufficient thickness of the thread rubber layer. The solid centers may preferably have an outer diameter of from 31 to 34 mm and a weight of from 20.0 to 28.0 g.

In the thread-wound golf balls of the present invention, the inner cover has appropriate hardness which gives good initial velocity and good durability since it is made of an ionomer resin having an acid content of not greater than 15 percent by weight. On the other hand, the outer cover has also appropriate hardness which gives good initial velocity, good durability, good spin properties and satisfactory feel on impact since it has a hardness of from 43 to 53 on the Shore D scale. Thus, according to the present invention, by using the above-mentioned two-layer cover as a cover of a thread-wound golf ball which usually gives more spin than a two-piece ball, the resulting golf balls can provide good spin properties and pleasant feel on impact preferred by a skilled golf player, and sufficient durability and sufficient travel distance.

EXAMPLES AND COMPARATIVE EXAMPLES

The present invention will be described in more detail with reference to the following Examples, Comparative Examples and Reference Examples, which do not restrict the present invention.

Examples 1 to 3 and Comparative Example 1 to 3

Thread-wound golf balls as shown in Tables 1 and 2 were prepared. These golf balls were prepared, as shown in FIG. 1, by winding thread rubber 4 around a solid center 2 to form a thread rubber ball 6, coating an inner cover 8 on the thread rubber ball 6 by compression molding, and then coating an outer cover 10 on the inner cover 8 by compression molding.

Tables 1 and 2 show the composition (resin formulation), acid content, Shore D scale hardness, MFR and thickness of the inner covers; the composition (resin formulation), Shore D scale hardness and thickness of the outer covers; and the properties of the solid centers, the thread rubber balls and the resulting golf balls. The Shore D scale hardness was measured in accordance with ASTM 2240. The hardness of the solid centers were measured by a JIS-C testing equipment.

In Tables 1 and 2, "Himilan" is a trade name of an ionomer resin produced by DuPont-Mitsui Polychemical Co., Ltd.; "Surlyn" is a trade name of an ionomer resin produced by E. I. DuPont; and the type of a metal ion is indicated in a parenthesis. Further, "Nucrel" is a trade name of an ethylene-methacrylic acid copolymer produced by DuPont-Mitsui Polychemical Co., Ltd.

TABLE 1

| | Examples | | |
|---|---|---|---|
| | 1 | 2 | 3 |
| Inner Cover Formulation (wt %) | | | |
| Himilan 1605 (Na) | 50 | 30 | |
| Himilan 1856 (Na) | | 20 | |
| Himilan 1555 (Na) | | | 50 |
| Himilan 1557 (Zn) | 25 | 50 | 50 |
| Himilan 1706 (Zn) | 25 | | |
| Himilan AM7317 (Zn) | | | |
| Acid Content (wt %) | 14.0 | 12.0 | 11.0 |
| Shore D Hardness | 63 | 61 | 62 |
| MFR (190° C.) | 2.5 | 3.5 | 7.5 |
| Thickness (mm) | 0.8 | 0.8 | 0.8 |
| Outer Cover Formulation (wt %) | | | |
| Surlyn 8120 (Na) | 50 | 50 | 50 |
| Himilan 1856 (Na) | | | |
| Himilan 1557 (Zn) | 50 | 50 | 50 |
| Himilan 1855 (Zn) | | | |
| Nucrel N0825J | | | |
| Shore D Hardness | 51 | 51 | 51 |
| Thickness (mm) | 0.8 | 0.8 | 0.8 |
| Solid Center | | | |
| Outer Diameter (mm) | 31.5 | 31.5 | 31.5 |
| Weight (g) | 23.0 | 23.0 | 23.0 |
| Hardness (JIS-C) | 60.4 | 60.4 | 60.4 |
| Thread Rubber Ball | | | |
| Outer Diameter (mm) | 40.0 | 40.0 | 40.0 |
| Weight (g) | 36.3 | 36.3 | 36.3 |
| Resulting Golf Ball | | | |
| Outer Diameter (mm) | 42.7 | 42.7 | 42.7 |
| Weight (g) | 45.3 | 45.3 | 45.3 |
| Results of Durability Test | 0/20 | 0/20 | 0/20 |
| Defective Unit Rate (No./No.) | | | |
| Results of Distance Test | | | |
| Initial Velocity (m/s) | 65.4 | 65.3 | 65.4 |
| Spin Quantity (rpm) | 2880 | 2900 | 2890 |
| Launch Angle (degree) | 10.1 | 10.0 | 10.1 |
| Carry Travel Distance (m) | 211.8 | 211.6 | 211.7 |
| Total Travel Distance (m) | 227.1 | 226.7 | 227.0 |
| Approach Spin (rpm) | 6000 | 6140 | 6110 |

TABLE 2

| | Comparative Examples | | |
|---|---|---|---|
| | 1 | 2 | 3 |
| Inner Cover Formulation (wt %) | | | |
| Himilan 1605 (Na) | 50 | 50 | 50 |
| Himilan 1856 (Na) | | | |
| Himilan 1555 (Na) | | | |
| Himilan 1557 (Zn) | | 25 | 25 |
| Himilan 1706 (Zn) | | 25 | 25 |
| Himilan AM7317 | 50 | | |
| Acid Content (wt %) | 16.5 | 14.0 | 14.0 |
| Shore D Hardness | 65 | 63 | 63 |
| MFR (190° C.) | 1.9 | 2.5 | 2.5 |
| Thickness (mm) | 0.8 | 0.8 | 0.8 |
| Outer Cover Formulation (wt %) | | | |
| Surlyn 8120 (Na) | 50 | | 20 |
| Himilan 1856 (Na) | | 50 | |
| Himilan 1557 (Zn) | 50 | | 10 |

TABLE 2-continued

| | Comparative Examples | | |
|---|---|---|---|
| | 1 | 2 | 3 |
| Himilan 1855 (Zn) | | 50 | 10 |
| Nucrel N0825J | | | 60 |
| Shore D Hardness | 51 | 57 | 41 |
| Thickness (mm) | 0.8 | 0.8 | 0.8 |
| Solid Center | | | |
| Outer Diameter (mm) | 31.5 | 31.5 | 31.5 |
| Weight (g) | 23.0 | 23.0 | 23.0 |
| Hardness (JIS-C) | 60.4 | 60.4 | 60.4 |
| Thread Rubber Ball | | | |
| Outer Diameter (mm) | 40.0 | 40.0 | 40.0 |
| Weight (g) | 36.3 | 36.3 | 36.3 |
| Resulting Golf Ball | | | |
| Outer Diameter (mm) | 42.7 | 42.7 | 42.7 |
| Weight (g) | 45.3 | 45.3 | 45.3 |
| Results of Durability Test | 7/20 | 0/20 | 0/20 |
| Defective Unit Rate (No./No.) | | | |
| Results of Distance Test | | | |
| Initial Velocity (m/s) | 65.5 | 65.5 | 65.2 |
| Spin Quantity (rpm) | 2860 | 2710 | 3100 |
| Launch Angle (degree) | 10.1 | 10.2 | 9.9 |
| Carry Travel Distance (m) | 211.0 | 212.1 | 209.3 |
| Total Travel Distance (m) | 226.9 | 227.3 | 222.6 |
| Approach Spin (rpm) | 5940 | 4280 | 6400 |

Further, the solid centers were prepared by subjecting the rubber compositions described below to vulcanization at 155° C. for 15 minutes. In addition, "Percumyl D" is a trade name of dicumyl peroxide produced by Nihon Yushi, and "Perhexa 3M" is a trade name of 1,1-di-t-butylperoxy-3,3,5-trimethylcyclohexane produced by Nihon Yushi.

[Rubber Compositions]

| | |
|---|---|
| Butadiene Rubber | 100.0 parts by weight |
| Zinc Oxide | 10.0 parts by weight |
| Stearic Acid | 1.0 part by weight |
| Barium Sulfate | 57.8 parts by weight |
| Zinc Acrylate | 20.0 parts by weight |
| Percumyl D | 0.6 parts by weight |
| Perhexa 3M | 0.6 parts by weight |

The thread-wound golf balls prepared in the Working Examples and the Comparative Examples were subjected to durability test, distance test and approach spin test. These testings were conducted as follows.

Durability Test

Using a shooting test machine, the balls were hit 200 times with a No.1 Wood at a head speed of 45 m/s, to count the number of balls wherein the cover was fractured. The defective unit rate was determined using the number of balls with a fractured cover out of 20 balls.

Distance Test

Using the shooting test machine, the balls were hit with a No.1 Wood at a head speed of 45 m/s, to measure the initial velocity, spin quantity, launch angle, carry travel distance and total travel distance.

Approach Spin Test

Using the shooting test machine, the balls were hit with a sand wedge at a head speed of 20 m/s for approach test, to measure the spin quantity for approach shot.

The results are as shown in Tables 1 and 2. As shown in Tables 1 and 2, it was found that the thread-wound golf balls prepared in the Working Examples showed sufficient durability with keeping sufficient initial velocity and sufficient travel distance, and further showed large spin quantity, resulting in spin properties preferred by a skilled golf player. According to the results of the sensory test, it was also found that the golf balls of the present invention provided reasonably soft feel on impact which is preferred by a skilled golf player.

On the contrary, the golf balls comprising an inner cover made of an ionomer resin having and acid content of more than 15 percent by weight (Comparative Example 1) showed poor durability since 7 balls suffered cover fracture out of 20 balls. In this case, the cover fracture appeared from 120 times shot. Further, the golf balls comprising an outer cover having a hardness of more than 53 on the Shore D scale (Comparative Example 2) showed poor approach properties (shortage in spin quantity for approach shot), and those with an outer cover having a hardness of less than 43 (Comparative Example 3 ) showed short travel distance.

REFERENCE EXAMPLES

Reference Examples 1 to 5

The Reference Examples will show one embodiment of a thread-wound golf ball comprising a solid center having an intrinsic frequency of from 2,000 to 4,000 Hz, an outer diameter of from 30 to 35 mm and a weight of from 19.5 to 29.0 g. Using the same method as used in the above-mentioned Working Examples, thread-wound golf balls as shown in Table 3 were prepared. The inner cover and the outer cover used in the Reference Examples were the same as those used in the above-mentioned Example 1.

Table 3 shows the formulation, outer diameter, weight, hardness, and intrinsic frequency of the solid centers; and the properties of the thread rubber balls and the resulting golf balls. The solid centers were prepared by subjecting the rubber compositions as described in Table 3 to vulcanization at 155° C. for 15 minutes.

TABLE 3

| | Reference Examples | | | | |
|---|---|---|---|---|---|
| | 1 | 2 | 3 | 4 | 5 |
| Solid Center Formulation (p.b.w.) | | | | | |
| Butadiene Rubber BR01 | 100.0 | 100.0 | 100.0 | 100.0 | 100.0 |
| Zinc Oxide | 10.0 | 10.0 | 10.0 | 10.0 | 10.0 |
| Stearic Acid | 1.0 | 1.0 | 1.0 | 1.0 | 1.0 |
| Barium Sulfate | 57.8 | 59.4 | 55.8 | 60.1 | 55.0 |
| Zinc Acrylate | 20.0 | 14.0 | 27.0 | 8.0 | 30.0 |
| Percumyl D | 0.6 | 0.6 | 0.6 | 0.6 | 0.6 |
| Perhexa 3M | 0.6 | 0.6 | 0.6 | 0.6 | 0.6 |
| Outer Diameter (mm) | 31.5 | 31.5 | 31.5 | 31.5 | 31.5 |
| Weight (g) | 23.0 | 23.0 | 23.0 | 23.1 | 23.0 |
| Hardness (mm) | 1.7 | 2.6 | 1.2 | 3.5 | 1.0 |
| Intrinsic frequency (Hz) | 3100 | 2200 | 3600 | 1800 | 4300 |
| Thread Rubber Ball | | | | | |
| Outer Diameter (mm) | 40.0 | 40.0 | 40.0 | 40.0 | 40.0 |
| Weight (g) | 36.3 | 36.3 | 36.3 | 36.3 | 36.3 |
| Resulting Golf Ball | | | | | |
| Outer Diameter (mm) | 42.7 | 42.7 | 42.7 | 42.7 | 42.7 |
| Weight (g) | 45.3 | 45.3 | 45.3 | 45.3 | 45.3 |
| Hardness (mm) | 2.9 | 2.9 | 2.9 | 2.9 | 2.9 |
| Results of Distance Test | | | | | |
| Head Speed 50 m/s | | | | | |
| Spin Quantity (rpm) | 2660 | 2630 | 2790 | 2610 | 2950 |

TABLE 3-continued

| | Reference Examples | | | | |
|---|---|---|---|---|---|
| | 1 | 2 | 3 | 4 | 5 |
| Initial Velocity (m/s) | 73.1 | 73.1 | 73.0 | 73.1 | 72.8 |
| Launch Angle (degree) | 9.2 | 9.2 | 9.2 | 9.2 | 9.1 |
| Carry Travel Distance (m) | 233.2 | 231.9 | 232.5 | 231.0 | 225.3 |
| Total Travel Distance (m) | 241.6 | 240.7 | 240.4 | 239.4 | 236.7 |
| Head Speed 45 m/s | | | | | |
| Spin Quantity (rpm) | 2870 | 2840 | 3080 | 2800 | 3220 |
| Initial Velocity (m/s) | 66.0 | 65.8 | 65.9 | 65.7 | 65.6 |
| Launch Angle (degree) | 9.0 | 9.0 | 8.9 | 9.1 | 8.7 |
| Carry Travel Distance (m) | 208.7 | 207.3 | 208.9 | 207.2 | 205.1 |
| Total Travel Distance (m) | 217.8 | 216.2 | 216.5 | 215.9 | 211.7 |
| Results of Durability Test Defective Unit Rate (No./No.) | 0/30 | 0/30 | 0/30 | 0/30 | 12/30 |
| Results of Feel on Impact Test | ⊙ | ⊙ | ⊙ | ○ | x |

The hardness and intrinsic frequency of the solid centers; and the hardness of the resulting golf balls were measured as follows.

Hardness of the Solid Center

The hardness of the solid center was determined by the amount of deformation (mm) under a load of 30 Kg applied to the solid center, with the amount of deformation under an initial load of 1 Kg being fixed as 0 mm.

Hardness of the Resulting Golf Balls

The hardness of the resulting golf balls was determined by the amount of deformation (mm) under a load of 100 Kg applied to the golf ball, with the amount of deformation under an initial load of 1 Kg being fixed as 0 mm.

Intrinsic frequency of the Solid Centers

Figure 2:
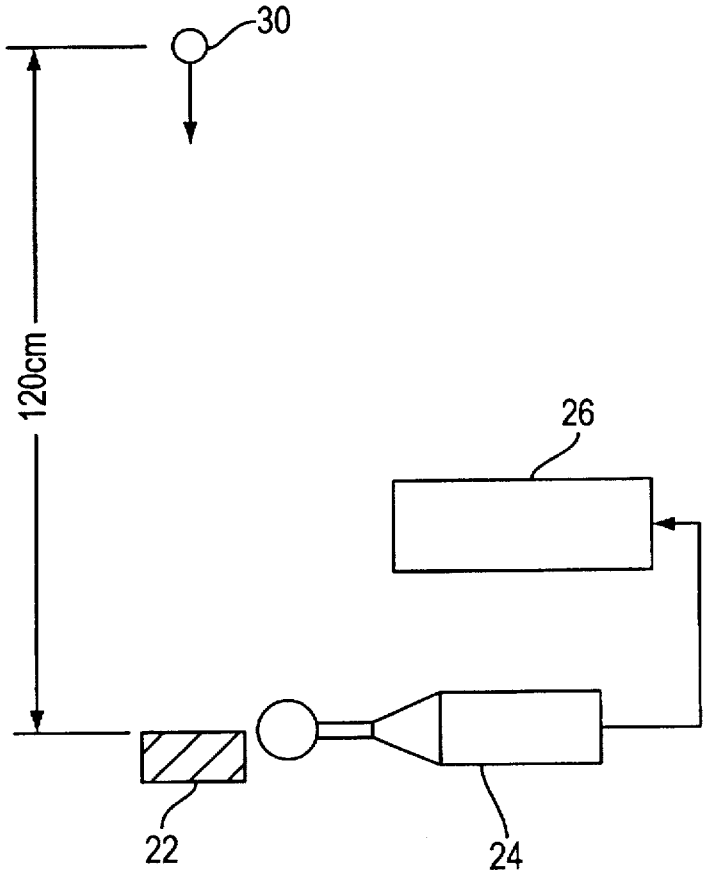
FIG. 2 shows a schematic view of an equipment used to measure intrinsic frequency of a solid center.

The intrinsic frequency was measured using an equipment as shown in FIG. 2. In FIG. 2, Numerical 22 indicates a steel disc having a diameter of 20 cm and a height of 10 cm; Numerical 24 indicates a sound level meter located close to the disc 22; and Numerical 26 indicates a FFT analyzer (frequency analyzer using high speed Fourier transform). As the sound level meter 24, N-A61 produced by Rion (Range: 70 dB) was used. As the FFT analyzer, CT-360 produced by Ono Measurement Equipment was used.

Figure 3:
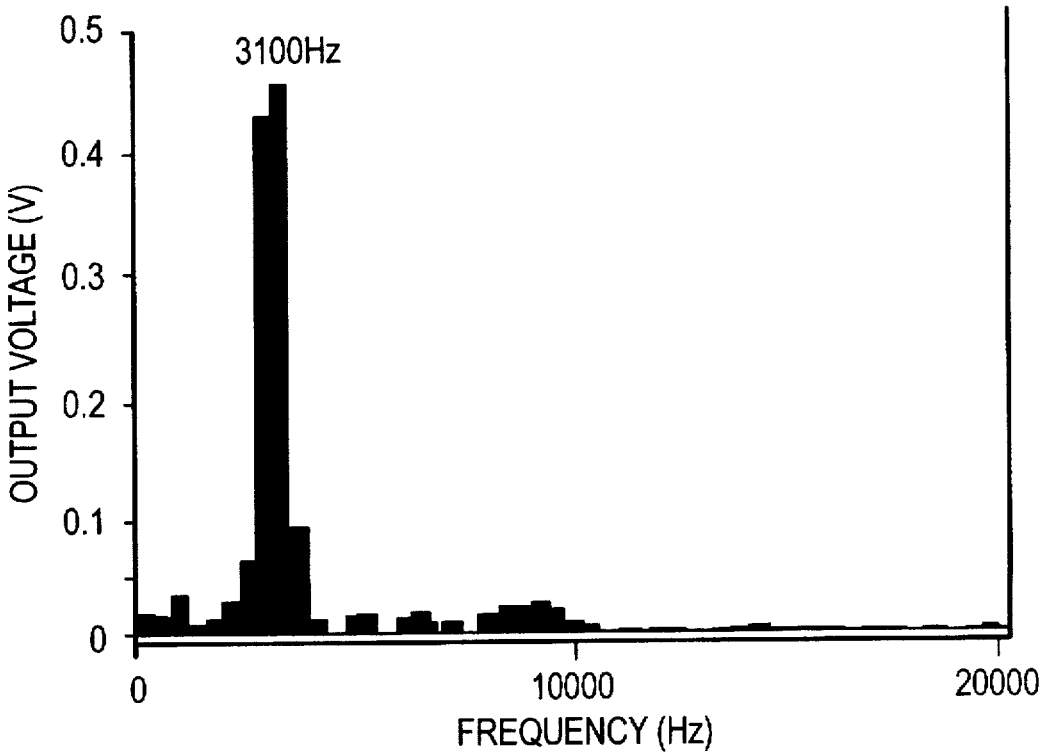
FIG. 3 shows a power spectrum of a restitution sound of a solid center used in Reference Example 1.
Figure 4:
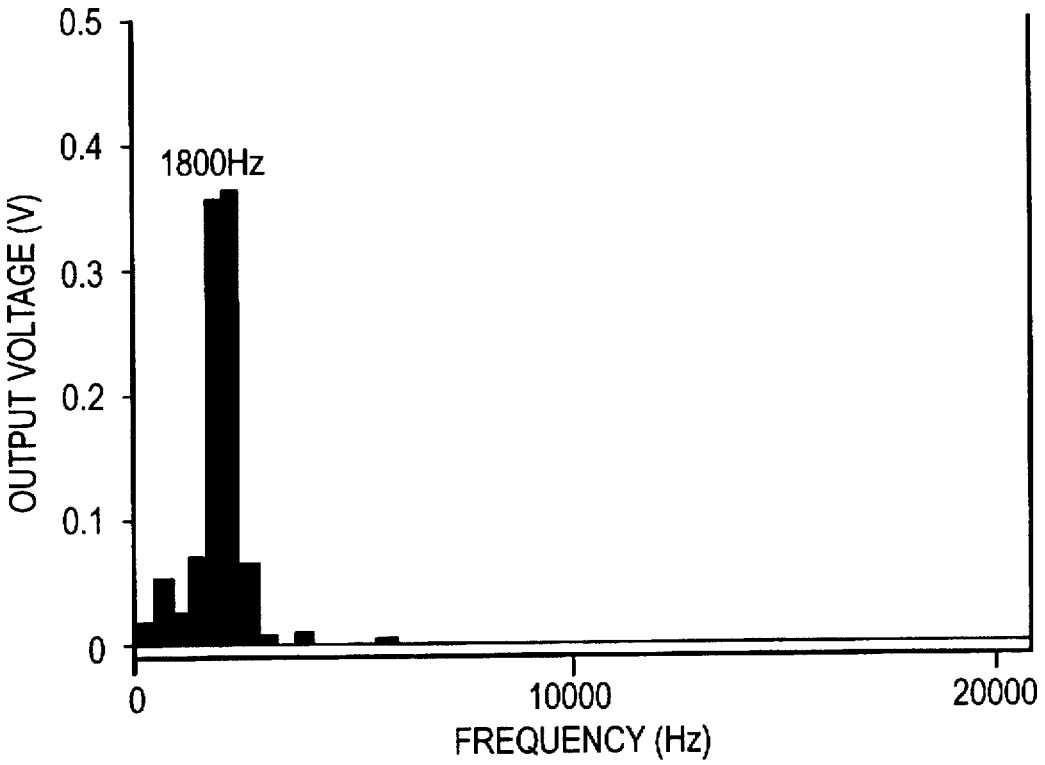
FIG. 4 shows a power spectrum of a restitution sound of a solid center used in Reference Example 4.
Figure 5:
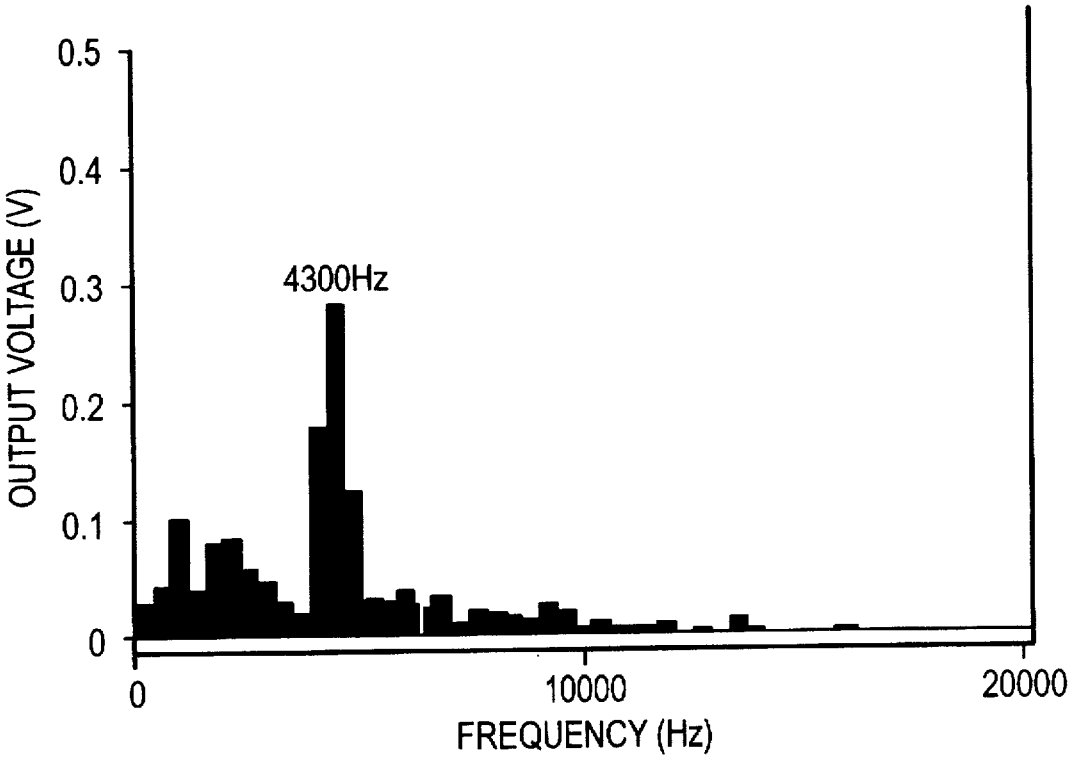
FIG. 5 shows a power spectrum of a restitution sound of a solid center used in Reference Example 5.

The measurement using the equipment shown in FIG. 2 was conducted as follows. The solid center 30 was dropped from a height of 120 cm onto the disc 22, to collect the restitution sound generated upon impact between the disc 22 and the solid center 30. The collected sound was subjected to frequency analysis by the FFT analyzer 26 to show and record power spectrum on a computer display. The peak frequency found was determined as intrinsic frequency. The power spectra obtained are shown in FIGS. 3 to 5. FIGS. 3 to 5 show the power spectrum obtained from the solid centers of Reference Example 1, Reference Example 4 and Reference Example 5, respectively.

Using the thread-wound golf balls prepared in the Reference Examples, feeling test (sensory test), distance test, durability test and feel on impact test were conducted as follows.

Feeling Test

The golf balls were hit by three professional golfers, to give sensory evaluations on feel on impact and hitting sound.

Distance Test Using the shooting test machine, the golf balls were hit with a No. 1 Wood at a head speed of 50 m/s and 45 m/s, respectively, to measure the spin quantity, initial velocity, launch angle, carry travel distance and total travel distance.

Durability Test

Using the shooting test machine, the golf balls were hit 200 times with a No. 1 Wood at a head speed of 45 m/s. The number of the balls with a fractured cover was counted. The defective unit rate was determined by the number of the balls with the fractured cover out of 30 balls.

Feel on Impact Test The balls were hit by three professional golfers, to give sensory evaluations on feel on impact. The ratings for the evaluations were as follows.

⊙: Very good feel on impact

○: Good feel on impact x: Poor feel on impact

The results of the feeling test are described below. The results of the distance test, the durability test and the feel test are as shown in Table 3.

Result of Feel Test

Reference Examples 1 to 3: Firm feel on impact with good "click" sound

Reference Example 4: Soft feel on impact without "click" sound

Reference Example 5: Solid feel on impact with metal sound

As a result, it was found that the golf balls comprising a solid center having an intrinsic frequency of from 2,000 to 4,000 Hz, an outer diameter of from 30 to 35 mm and a weight of from 19.5 to 29.0 g (Reference Examples 1to 3) gave good "click" sound on impact with reasonably soft and firm feel on impact, and good travel distance.

On the contrary, the golf balls comprising a solid center having an intrinsic frequency of less than 2,000 Hz (Reference Example 4) and having an intrinsic frequency of more than 4,000 Hz (Reference Example 5) gave no good "click" sound on impact, unsatisfactory feel on impact and poor travel distance.

We claim:

1. A thread-wound golf ball comprising, a thread rubber ball prepared by winding thread rubber around a center, and a two layer cover enclosing the thread rubber ball therewith and comprising an inner cover made of an ionomer resin mixture or blend of ionomers having an acid content of not greater than 15 percent by weight, and a melt flow rate measured at 190° C. of from 2 to 9 and an outer cover made of a resin having a hardness of 43 to 53 on the Shore D scale.

2. A thread-wound golf ball according to claim 1, wherein the ionomer resin used to form an inner cover is selected from those resins prepared by cross-linking a copolymer of an olefin having from 2 to 8 carbon atoms and an unsaturated monocarboxylic acid having from 3 to 8 carbon atoms with a metal ion.

3. A thread-wound golf ball according to claim 2, wherein the ion metal is $Na^+$, $Zn^{2+}$, $Ca^{2+}$ or $Mg^{2+}$.

4. A thread-wound golf ball according to claim 1, wherein the ionomer resin used to form the inner cover has an acid content of from 8 to 15 percent by weight.

5. A thread-wound golf ball according to claim 1, wherein the resin used to form the outer cover is selected from ionomer resins, balata, polyurethane based thermoplastic elastomers, polyester based thermoplastic elastomers and polyamide based thermoplastic elastomers.

6. A thread-wound golf ball according to claim 5, wherein the resin used to form the outer cover has a hardness of from 45 to 50 on the Shore D scale.

7. A thread-wound golf ball according to claim 1, wherein the inner cover has a thickness of from 0.5 to 1.5 mm.

8. A thread-wound golf ball according to claim 7, wherein the total thickness of the inner cover and the outer cover is in the range of from 1.0 to 3.0 mm.

9. A thread-wound golf ball according to claim 1, wherein the center has an intrinsic frequency of from 2,000 to 4,000 Hz, an outer diameter of from 30 to 35 mm, and a weight of from 19.5 to 29.0 g.

* * * * *